United States Patent [19]

Schäfer

[11] Patent Number: 4,712,748

[45] Date of Patent: Dec. 15, 1987

[54] MISSILE

[75] Inventor: Berthold Schäfer, Bergisch Gladbach, Fed. Rep. of Germany

[73] Assignee: Deutsche Forchungs- und Versuchsanstalt fur Luft- und Raumfahrt e.V., Cologne, Fed. Rep. of Germany

[21] Appl. No.: 940,520

[22] Filed: Dec. 10, 1986

[30] Foreign Application Priority Data

Dec. 28, 1985 [DE] Fed. Rep. of Germany ..... 3546269

[51] Int. Cl.[4] ..... F42B 15/033

[52] U.S. Cl. ..... 244/3.22

[58] Field of Search ..... 244/3.22; 102/384

[56] References Cited

U.S. PATENT DOCUMENTS

| | | | |
|---|---|---|---|
| 3,282,541 | 11/1966 | Webb | 244/3.22 |
| 3,304,029 | 2/1967 | Ludtke | 244/3.22 |
| 3,637,167 | 1/1972 | Froning, Jr. et al. | 244/3.22 |
| 4,623,107 | 11/1986 | Misöph | 244/3.22 |

*Primary Examiner*—Charles T. Jordan

*Attorney, Agent, or Firm*—Spensley Horn Jubas & Lubitz

[57] ABSTRACT

The missile (10) comprises at its rear end in flying direction (A) tail fins (14, 16, 18) whose front edges (14F, 16F, 18F) are sharpened at both sides. Intermediate the tail fins, outflow openings (22) are arranged on the body (12) to eject therethrough fuel into the supersonic external flow forming about the body (12). Due to supersonic flow, there are generated shock wave fronts extending from the front edges (14F, 16F, 18F) and being reflected by adjacent tail fins, said shock waves of the shock wave fronts interfering with the supersonic flow passing along the body so that recirculation fields are formed between the tail fins. The said recirculation fields are formed within the range of corner flow and outlfow openings (22) so that fuel discharged from the latter is burnt down with the formation of a locally stable flame. As a result of the volume increase resulting from the combustion, a high-pressure area develops between the tail fins. The pressure produces a force directed transversely to the flying direction and causing a control of the missile (10).

18 Claims, 2 Drawing Figures

MISSILE

Figure 1:
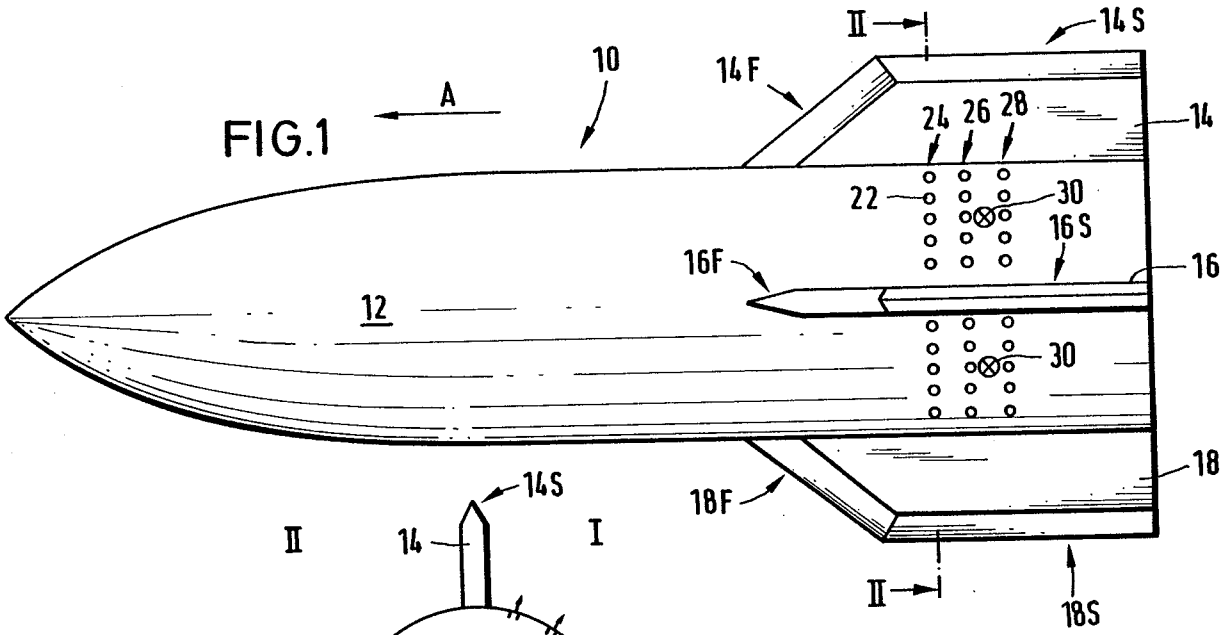

The invention relates to a missile, in particular a supersonic missile which comprises a body and, at its rear end, in the direction of flight, a number of tail fins.

Normally, the body of missiles is provided with tail fins. Generally, missiles, such as rockets or cruise missiles, are controlled by ailerons whose position relative to the body is changed accordingly. It is also possible to use a so-called thrust-vector-control by deviating the propellant gas flow discharged from the missile. Further, in case of another type of control, control gases are allowed to flow transversely and pulsewise out of the missile body. The rear body end of a missile controlled by such a pulsewise system comprises flight direction apertures through which a control gas is discharged, while a force transverse to the flight direction acts on the missile. Subject to the desired flight direction, the gas is discharged through specific apertures only. Due to the suddenly discharged gas, a pulse is imparted to the missile which thus is caused to change its flight direction. In order to obtain an effective control, it is necessary for the gas to be pressed at high pressure through the apertures into the air passing along the body of the missile. In view of the relatively big air masses under high pressure required aboard the missile for its control, the resultant weight and space problems in the missile are considerable.

It is the object of the invention to provide a missile requiring for the control of its flight direction only unimportant amounts of fuel.

The object is solved according to the invention in that between adjacent tail fins of the body in an area where, due to shock waves originating from the front edges of the tail fins, the speed of air passing along the body is decreased, at least one outflow aperture is provided from which fuel is discharged to change the flight direction.

In case of the instant invention, the missile body is provided with at least one outflow opening being situated intermediate adjacent tail fins and, in view of the control of the flight direction, being adapted to discharge a fuel which is ignited outside the missile. Without additional measures, the flame caused by the ignition of the discharged fuel would become immediately unstable due to the air passing at supersonic speed along the missile body. In other words, said flame will be blown out at once or the combustion of the fuel will take place in a region behind the missile. To stabilize the flame formed by the combustion of fuel, the outflow opening is provided in a missile body region in which the speed of air passing therealong is reduced. Such a region, a so-called recirculation range, develops in that a shock wave originating from one of the front edges of a tail fin and constitued of air passing along the missile is reflected by an adjacent tail fin. When striking on the adjacent tail fin, said shock wave interferes with the corner flow between tail and body which, due to the wall friction, is substantially slower than the unaffected flow. By the interference of the shock wave with said corner flow, a recirculation area is produced in the vicinity of the tail fins.

The outflow opening is provided as a nozzle of the missile body within a region where the recirculation field is formed. In fact, the flow speed within the recirculation field is substantially lower than the speed of the air passing along the body outside said field. The flame formed upon the ignition of the fuel discharged from the outflow opening may be locally stabilized accordingly even at a multiple sonic speed. In other words, the flame is formed in a direct vicinity of the missile body, on the one hand, and it is not destroyed by air passing along the body, nor is it displaced to behind the missile, on the other hand. In case of the missile of the invention, the shock waves are used for the stabilization of the flame. Due to the fuel ignited within the recirculation field, there is caused in the direct vicinity of the missile body an increase in volume which is responsible for a local pressure rise at the missile body thus entailing a change of its flight direction. Hence, the missile is controlled by a pressure rise within an area locally defined exactly by the tail fins at the body of the missile. Since, as a result of the fuel combustion, an important increase in volume and a high pressure rise are caused in the air passing along the missile body (external combustion), only low fuel amounts are required aboard the missile which may be of a reduced size and weight accordingly. The control of the missile may be performed within a short term thus allowing short reaction times. The control may be used during the total flight phase, i.e. during the starting and also during the cruising phase. However, it is particularly effective in the supersonic range. Movable parts susceptible to troubles such as ailerons are not required.

According to a preferred embodiment of the invention, both sides of the front edges of the tail fins are of a sharp acute-angular form. By said special design, the front edges of the tail fins do not offer a substantial resistance to the air passing along the missile body. Already a front edge extending at an angle of about 20° gives rise to the formation of shock waves of an intensity which is sufficient to generate a proper recirculation field.

According to another embodiment of the invention, an ignition means intermediate two adjacent tail fins serves for the ignition of fuel ejected from the nozzle. The use of the ignition means is dictated by the kind of fuel and by the speed of the missile. If fuel is for instance used which, in case of high flying speeds of the missile (e.g. at quadruple supersonic speed) is self-ignited due to the high stagnation temperatures, the ignition means is only required during the starting phase of the missile, while, as a rule, during its crusing phase, said ignition means is not required for igniting fuel thus allowing a simpler control of the missile.

Another preferred embodiment of the invention is characterized in that between adjacent tail fins, a number of outflow openings is arranged in a row in which the outer outflow openings are always provided in the direct vicinity of a tail fin. In fact, the recirculation fields are particularly formed in the direct vicinity of a tail fin, because, due to the friction of bypassing air, corner flow is braked most of all at the missile body and at the tail fin. The fuel ejected through the external outflow openings of the row into said particularly well defined recirculation fields forms during its combustion a locally stable flame which, from there, is quickly propagated over the total row of outflow openings. Thus, a broad flame area may be realised between the tail fins and a very effective control may be achieved accordingly.

In another advantageous embodiment of the invention, a plurality of successive rows of outflow openings ensures that between two adjacent tail fins, a very large-surface area is formed in which the ejected fuel may burn down and again with a possible most effective control of the missile.

If, such as provided in another embodiment of the invention, the used fuel is hydrogen, its self-ignition upon its discharge from the outflow openings is taking place in case of supersonic speeds of the missile within four times the sonic speed. Due to the high stagnation temperatures of the air passing at supersonic speed along the missile body, resultant temperatures as high as about 800° C. are causing a self-ignition of hydrogen. In said speed ranges of the missile, it is no longer necessary to provide an ignition means for igniting hydrogen, and the operations required for the control of the missile are simplified this way.

The tail portion of the missile of the invention is provided with a number of rigid fins. Due to nozzles mounted between adjacent fins, fuel may be ejected into the air passing along the missile body at supersonic speeds by which shock waves extending from the front edges of the tail fins are generated and reflected by the corresponding adjacent tail fin.

In case of said reflection, the shock wave interferes with the air which, due to its friction with the missile body, sweeps therealong at a reduced speed, said shock interference being particularly strong in the corners formed by the body and the tail fins. As a result of the shock interference, there are created, in the supersonic flow, recirculation fields in which a locally stable flame is formed during the combustion of fuel ejected into said fields.

The fuel pressure during the ejection need be slightly higher only than the air passing along the missile body. The external combustion of the fuel in the air flow surrounding the missile causes an increase of volume of the fuel/air mixture in the direct vicinity of the missile body with a resultant pressure rise in said area, said pressure rise within a field exactly defined locally by the tail fins acting on the missile body and being used for its control. In other words, said control is realised by the external combustion of a fuel and may be applied with a very quick reaction and during the total flying phase, i.e. during the starting and cruising phases of the missile. Only relatively low quantities of fuel are required thus allowing to reduce size and weight of the missile design. In the absence of any movable elements in the control system of the missile, its operation is very reliable.

Figure 2:
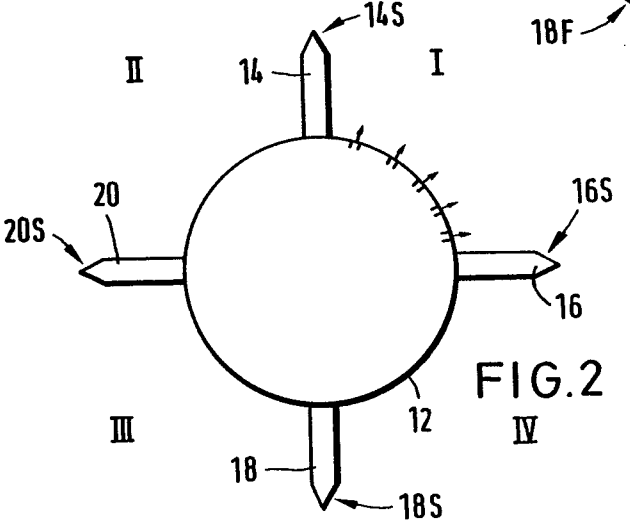

One embodiment of the invention will be explained hereunder in more detail with reference to the drawings in which FIG. 1 is a side view of the missile and FIG. 2 is a cross section along line II—II of FIG. 1.

Body 12 of missile 10 comprises four tail fins 14, 16, 18, 20 which, in flying direction A, are arranged at the rear end of said body 12. Both sides of the front edge of a tail fin (marked by F in addition to the reference numeral of the corresponding fin) are sharpened and pointed forwardly. The side edges of the tail fins extending radially to the outside (and marked by S in addition to the reference numerals of the respective tail fin) are pointed to the outside.

Between adjacent tail fins 14 and 16, a plurality of nozzles are situated on body 12, of which always five nozzles 22 are positioned in a row extending transversely to flying direction A of missile 10, while three of said rows 24, 26 and 28 are arranged successively. Nozzles 22 disposed this way are located between all of the mutually adjacent tail fins of missile 10. All of the nozzles 22 of one row form one common circumferential circle on body 12 and are divided by the tail fins 16, 14, 20 and 18 into four groups including five nozzles each. One such group of nozzles 22 is coordinated to quadrant I, II, III and IV (FIG. 2). The distribution of nozzles 22 in rows 26 and 28 is made accordingly.

Through said nozzles 22, fuel is ejected into the air passing along body 12. All of nozzles 22 provided on body 12 are connected via lines (non-illustrated) to a fuel tank (non-illustrated either). Subject to the kind of control required for the flying direction of the missile, all nozzles 22 of a quadrant or nozzles of several quadrants may be provided with fuel. Each of the lines connected to the tank and responsible for the fuel supply to all of the nozzles of one quadrant comprises a valve for closing or opening said conduit. By this means, subject to the selection of the quadrant, all of its nozzles 22 are provided with fuel. Between the central row 26 and the last row 28, (seen in flying direction A), there is an ignition means 30—e.g. in the form of an ignition plug—to ignite the fuel ejected from the nozzles 22 of the respective quadrant.

With reference to the first quadrant (based on the area between the tail fins 14 and 16), the formation of a recirculation field between two adjacent tail fins shall be explained hereunder in more detail. In case of supersonic speed, two shock wave fronts originate from the front edge 14F of tail fin 14 and from the front edge 16F of tail fin 16, one of said shock wave fronts originating from the front edge 14F of the tail fin 14 extending towards tail fin 16, while one of the two shock wave fronts originating from front edge 16F of tail fin 16 extending towards tail fin 14. The shock waves of each of said fronts are reflected by the corresponding tail fins and interfere with the air passing along body 12 of missile 10, said air being braked by the friction with body 12 so that, in case of interference with the shock waves, recirculation fields are formed. By the friction, the flow of air passing along the body is slowed down most effectively in the corner (corner flow) between tail fins 14 and 16 and body 12 of missile 10. Therefore, the best developed recirculation fields are always situated in the vicinity of a tail fin.

Concerning missile 10 illustrated in FIG. 1, the shock waves of a shock wave front are reflected at the tail fins in a region extending between the frontmost row 24 and the rearmost row 28 at the tail fins. The best developed recirculation fields, as mentioned before, are in the direct vicinity of the tail fins, while smaller recirculation fields are formed within the body range including the central nozzles of individual rows, because, also in this case, the shock waves of the shock wave front interefere with the air passing along body 12.

To control missile 10, nozzles 22 of one or more quadrants are used, as required, to eject therethrough fuel into the air passing along body 12, the discharged fuel being ignited by an ignitign device 30 whereby a locally stable flame is formed. Due to the combustion of fuel, there is caused an increase of volume of the mixture present between tail fins 14 and 16 at the body 12 and formed of burnt down fuel and of air passing along the body 12. As a result of said increase in volume, pressure rises in the area exactly defined by tail fins 14 and 16. The increased pressure in said field acts on body 12 thus generating a transverse force directed transversely to the flying direction A of missile 10. The intensity of said transverse force may be regulated by the fuel amount per time unit ejected through nozzles 22 of a quadrant.

The pressure of the gaseous or liquid fuel discharged from nozzles 22 is only high enough to allow fuel to be discharged from body 12. No substantial control pulse is imparted to the missile by said pressure only. However, if the used fuel is hydrogen, and due to the stagnation temperature of air passing along body 12, a self-ignition of hydrogen is taking place from a specific speed of missile 10. The ignition temperature of hydrogen is near about 800° C. If the speed of the missile 10 is higher than about four times the sonic speed, under ground conditions, the air temperature at missile 12 will increase to above 800° C. because of the high stagnation temperatures so that a safe self-ignition of hydrogen is ensured. In case of such speed ranges of the missile, the operations performed in it may be simplified in that the corresponding ignition device need not be enabled with each control manoeuvre.

What is claimed is:

1. Missile, in particular a supersonic missile, which comprises a body provided with, at its rear end, in the direction of flight, a plurality of tail fins, and at least one outflow aperture, for discharging fuel capable of being ignited to change the flight direction of said missile, said outflow aperture being located between adjacent tail fins of the body in an area where, due to shock waves originating from the front edges of the tail fins, recirculations are formed.

2. Missile according to claim 1, characterized in that both sides of the front edges are of a sharpened acute-angled form.

3. Missile according to claim 1, characterized in that the fuel used is hydrogen.

4. Missile, in particular a supersonic missile, which comprises a body and, at its rear end, in the direction of flight, a number of tail fins, characterized in that between adjacent tail fins of the body in an area where, due to shock waves originating from the front edges of the tail fins, the speed of air passing along the body is decreased, at least one outflow aperture is provided from which fuel is discharged to change the flight direction, further characterized in that intermediate two adjacent tail fins, an ignition means is provided for the ignition of fuel ejected from the outflow opening.

5. Missile, in particular a supersonic missile, which comprises a body and, at its rear end, in the direction of flight, a number of tail fins, characterized in that between adjacent tail fins of the body in an area where, due to shock waves originating from the front edges of the tail fins, the speed of air passing along the body is decreased, at least one outflow aperture is provided from which fuel is discharged to change the flight direction, further characterized in that between adjacent tail fins a corresponding number of outflow openings are arranged in a row, in which the outer outflow openings are always disposed in the direct vicinity of a tail fin.

6. Missile according to claim 5, characterized in that the outflow openings are situated on one sole circumferential circle at the body.

7. Missile according to claim 5, characterized in that a plurality of successive rows of outflow openings are provided.

8. A missile adapted for flight, during which air flows over the missile body, comprising:

slowing means for slowing the air flow over portions of the missile body;

discharge means for discharging ignitable fuel into the air flow slowed by said slowing means;

wherein said ignitable fuel, when ignited in said air flow slowed by said slowing means, changes the direction of flight of said missile.

9. A missile as claimed in claim 8, wherein said ignitable fuel is self-ignitable due to high temperatures occurring during high speed flight.

10. A missile as claimed in claim 9, wherein said ignitable fuel is hydrogen.

11. A missile as claimed in claim 8, wherein said slowing means comprises a plurality of tail fins disposed on the missile body and adapted to provide shock waves which interfere with air flowing over the missile body during flight.

12. A missile, comprising:

a missile body having a front and a rear end;

discharge means for discharging unignited fuel adjacent said missile body, between said front and rear ends, said fuel being ignitable for producing a flame;

stabilization means for stabilizing a flame produced by ignition of said fuel during high speed flight.

13. A missile as claimed in claim 12, wherein said fuel is hydrogen and is self-ignitable during supersonic flight.

14. A missile adapted for flight, during which air flows over the missile body, comprising:

a first tail fin for providing a first shock wave;

a second tail fin in a spaced relationship to said first tail fin, for providing a second shock wave and for reflecting said first shock wave;

a recirculation area between said first and second tail fins, wherein said shock waves interfere with air flowing over the missile body, thereby providing an air flow having a flow speed substantially less than the flow speed of air not within the recirculation area;

at least one outflow aperture adjacent said recirculation area, for discharging combustible fuel into said recirculation area; and ignition means for igniting said fuel discharged into said recirculation area;

whereby, upon ignition of said fuel within said recirculation area, a force is imparted on the missile body for changing the direction of flight.

15. A system for modifying the flight direction of a missile comprising:

a missile body configured to define at least one recirculation area in which air flow speed relative to said missile body is reduced, a fuel outflow opening provided in said missile body adjacent said recirculation area, said fuel outflow opening adapted to discharge fuel which is ignited outside said missile body, whereby the ignition of said fuel outside said missile body modifies the flight direction of said missile.

16. A system for controlling the flight direction of a missile body, comprising:

storage means for storing combustible fuel within said missile body; and discharge means for discharging said combustible fuel from said missile body in an unignited state;

whereby ignition of said combustible fuel discharged from said missile body effects a change in flight direction of said missile body.

17. A method for controlling the flight direction of a missile body, comprising the steps of:

discharging a combustible fuel from said missile body; and igniting said combustible fuel externally with respect to the missile body;

whereby said combustible fuel, when ignited, effects a change in flight direction of said missile body.

18. Missile, in particular a supersonic missile, which comprises a body provided with, at its rear end, in the direction of flight, a number of tail fins and several outflow apertures out of which, for influencing the flight direction, a fuel capable of being ignited is discharged, wherein the outflow apertures are located between the tail fins in a missile body region in which recirculations are formed, said recirculations being generated by shock waves originating at the front edges of the tail fins.

* * * * *